United States Patent [19]

Kloenne et al.

[11] Patent Number: 4,567,654

[45] Date of Patent: Feb. 4, 1986

[54] BUSSING BLOCK

[75] Inventors: Ernest F. Kloenne, Warsaw, N.Y.; Garry A. Stout, Bargersville, Ind.

[73] Assignee: Emhart Industries, Inc., Indianapolis, Ind.

[21] Appl. No.: 741,027

[22] Filed: Jun. 3, 1985

Related U.S. Application Data

[63] Continuation-in-part of Ser. No. 595,684, Apr. 2, 1984, abandoned.

[51] Int. Cl.[4] ..... H01R 31/08

[52] U.S. Cl. ..... 29/876; 339/18 R; 339/19

[58] Field of Search ..... 339/18 R, 18 B, 18 C, 339/18 P, 19, 222, 242; 29/874, 884, 876

[56] References Cited

U.S. PATENT DOCUMENTS

| | | | |
|---|---|---|---|
| 3,208,028 | 9/1965 | Mittler et al. | 339/18 R |
| 3,212,048 | 10/1965 | Rosenberg et al. | 339/18 R |
| 3,353,138 | 11/1967 | Loose | 339/18 C |
| 3,571,779 | 3/1971 | Collier | 339/18 C |

*Primary Examiner*—Neil Abrams

*Attorney, Agent, or Firm*—Robert F. Meyer; Carl A. Forest

[57] ABSTRACT

A bussing block has wafers stacked one on top of the other and includes apertures which are in alignment with each other. Buss bars are carried on the wafers and have apertures aligned with the apertures in the wafers. Electrically insulating collars extend from selected ones of the wafer apertures so that when electrical terminals are inserted through all of the aligned apertures of the wafers and buss bars, the electrical terminals will be electrically isolated from the buss bars by the collars.

2 Claims, 3 Drawing Figures

BUSSING BLOCK

This application is a continuation-in-part of application Ser. No. 06,595,684, filed 4-2-84 now abandoned.

BACKGROUND OF THE INVENTION

This invention pertains to bussing blocks; and more particularly to bussing blocks which can be readily integrated with a terminal block for a timing mechanism.

Timing mechanisms are used to control the operation of appliances such as dryers, dishwashers, and washing machines by opening and closing electrical switches in response to the rotation of cam means. Usually the electrical switches, which are opened and closed, are comprised of moveable and fixed contact blades the ends of which are integral with or serve as electrical terminals. The electrical terminals are carried by terminal blocks in some sort of spaced relationship. Depending upon the desired operational sequences, the electrical terminals are sometimes electrically connected in accordance with a predetermined pattern by some sort of bussing means. These bussing means, which are normally thin strips of electrically conductive material, are usually carried by bussing blocks.

It is highly desirable that such bussing blocks be a unit in and of itself which may be easily connected and disconnected from the timing mechanism or terminal block such that a programmed sequence can be readily changed. Also if there are many bussing means to be used it is essential that the bussing means be electrically insulated from each other. Moreover, means should be provided to readily allow the bussing means to be positioned according to a desired pattern.

SUMMARY OF THE INVENTION

Accordingly, the present invention is directed to a bussing block which in general comprises at least one wafer, first apertures in the wafer, electrical bussing means carried on the wafer and including second apertures in alignment with the first apertures, electrical terminals extending through the first and second apertures, and electrical insulating means separating the bussing means from selected ones of the electrical terminals.

DETAILED DESCRIPTION OF THE INVENTION

Figure 1:
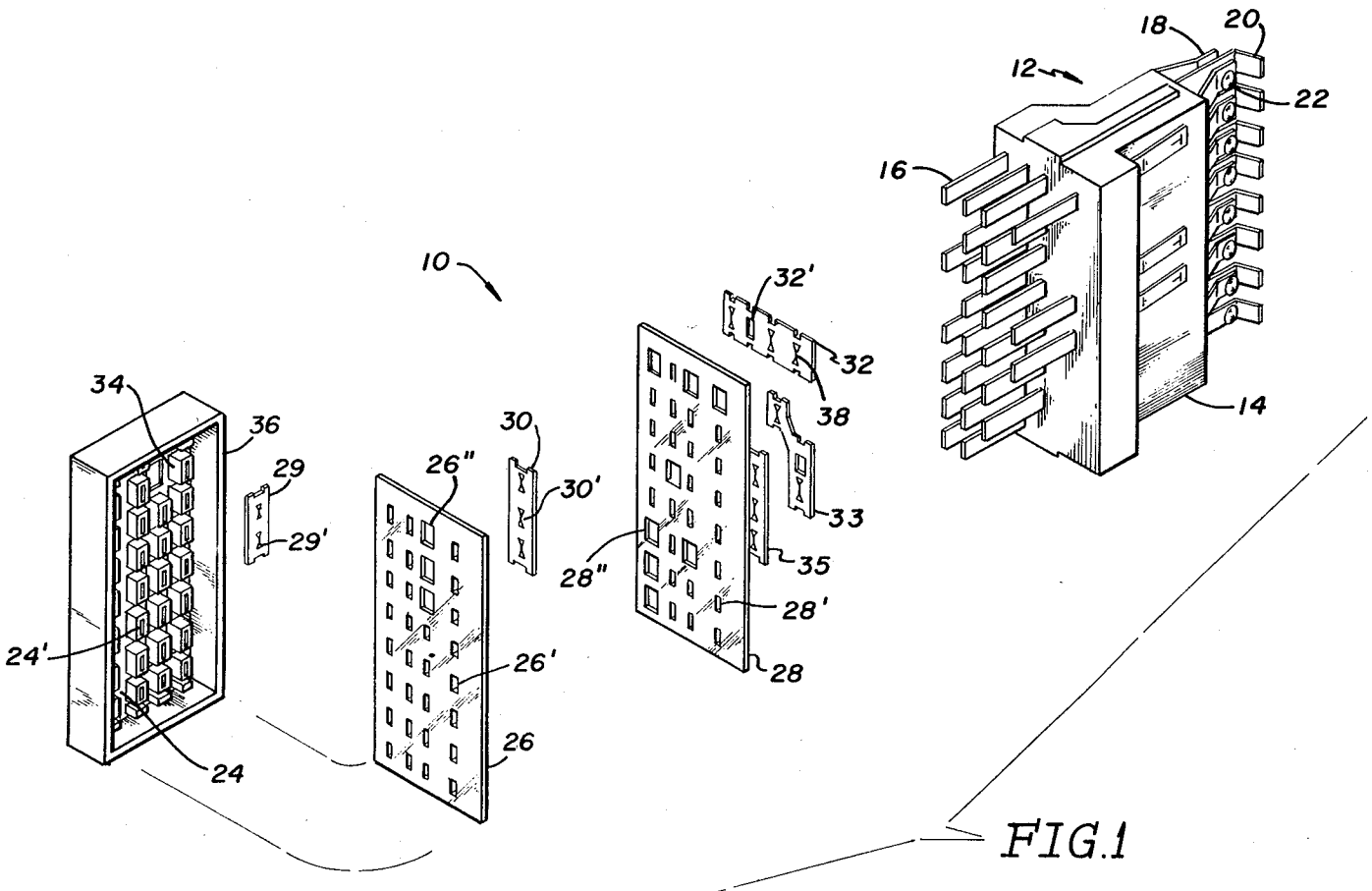
FIG. 1 is an exploded view of a bussing block showing the features of the invention in combination with a terminal block.

Referring to the drawings, there is shown a bussing block 10 as used in combination with a terminal block 12. Terminal block 12 includes a block 14 through which a plurality of electrical terminals 16 extend, the electrical terminals including electrical contact blades 18 and 20 with their electrical contacts 22.

Bussing block 10 includes a plurality of wafers 24, 26 and 28, each having apertures 24', 26' and 28' provided therein, and buss bars typically shown at 29, 30, 32, 33 and 35. As shown, wafer 24 has sidewalls 36 extending therefrom which capture and hold wafers 26 and 28 during assembly. It is understood that as many wafers as are needed can be used. Typically of all the buss bars, buss bars 29, 30 and 32 include apertures 29', 30' and 32'. The buss bars, as better shown in FIG. 3, lie flat on wafers 24, 26 and 28. The wafers are all fabricated from a suitable electrically insulative material such as plastic while the buss bars as well as electrical terminals are fabricated from a good electrically conductive material such as copper.

Figure 2:
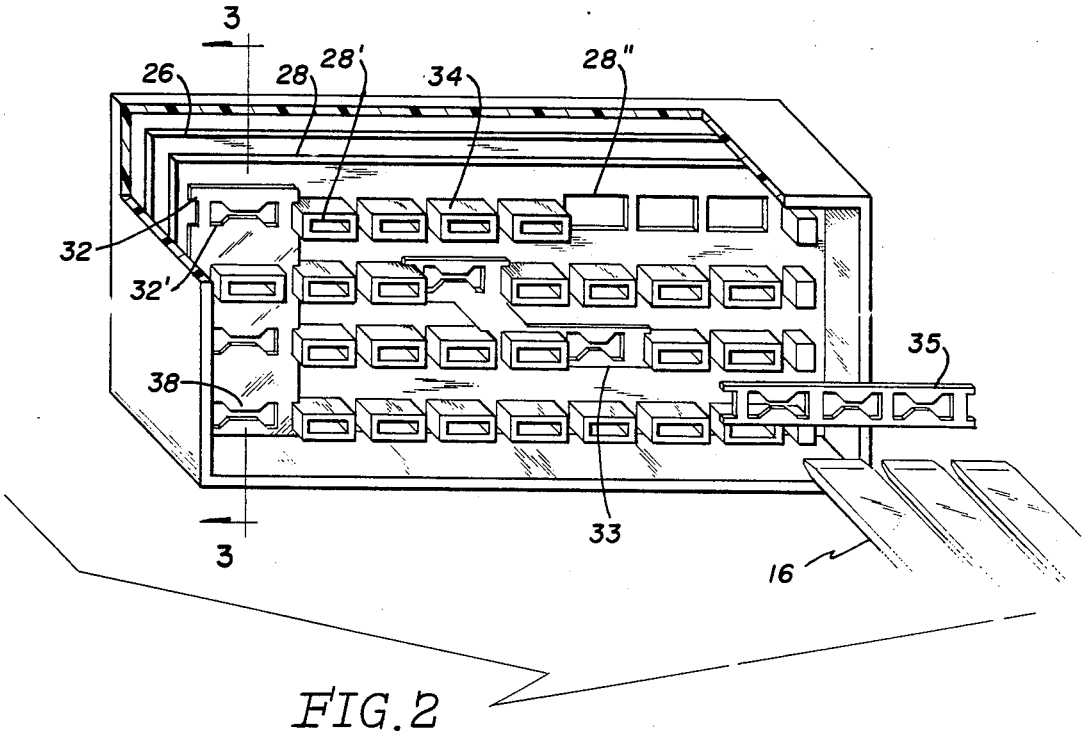
FIG. 2 is an exploded isometric view of the terminal block in combination with electrical terminals used in the block.

As best shown in FIG. 2, selected ones of the apertures in the wafers have collars 34 extending from their peripheries to provide an electrical insulating means between electrical terminals 16 extending through the apertures and the buss bars. The collars are also fabricated of plastic. As shown in FIG. 2, spring tabs 38 extend into the apertures of the bussing bars.

Figure 3:
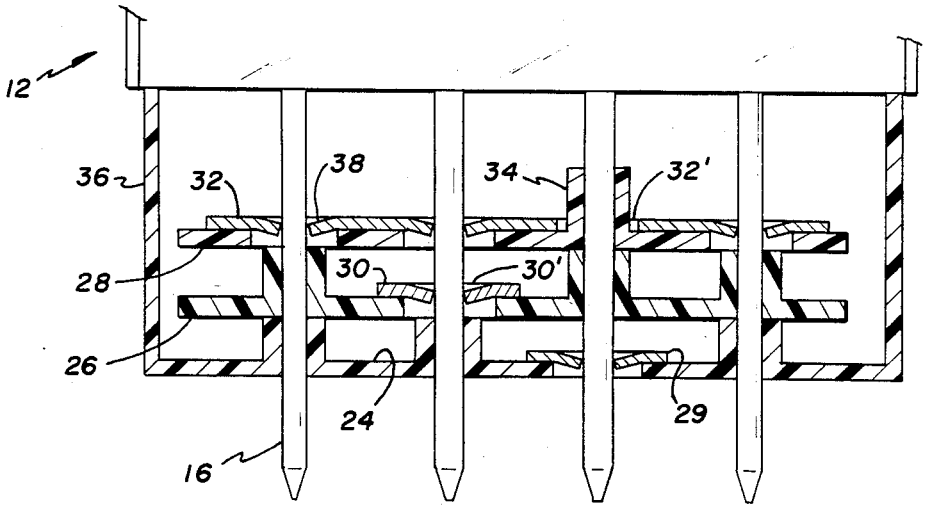
FIG. 3 is a view taken along the line 3—3 of FIG. 2.

Prior to assembly, collars 34 are removed at selected ones of the apertures in the wafers and enlarge the apertures 26" and 28", for example. In addition, spring tabs 38 are removed in the apertures of the buss bars corresponding to the remaining collars to permit the apertures of the buss bars to fit around or accommodate the collars where electrical bussing is not desired. When assembled, each wafer with its buss bars carried thereon are stacked one on top of the other. Referring to FIG. 3, when electrical terminals 16 are inserted through the apertures of the wafers, those going through the collars 34 will be electrically isolated from the buss bars, while those terminals going through the apertures without the collars will deflect the spring tabs 38 of the buss bars causing them to bear against the terminals to provide a positive electrical connection between the terminals and the buss bars.

What is claimed is:

1. A method of forming a bussing block comprising (1) providing a plurality of wafers, each of said wafers including a plurality of first apertures, and electrically insulative collars extending from each of said wafers around said first apertures, (2) providing a plurality of electrical buss bars, each of said buss bars having a plurality of second apertures therein and spring tabs extending into said second apertures, (3) removing selected ones of said collars, (4) removing selected ones of said spring tabs, (5) assembling said electrical buss bars on said wafers such that those of said second apertures having their spring tabs removed fit around the remaining collars, and (6) stacking said wafers with said buss bars one on top of the other such that all of said first and second apertures are aligned.

2. A method of forming a bussing block comprising (1) providing at least one wafer having a plurality of first apertures, and electrically insulative collars extending from said one wafer around said first apertures, (2) providing a plurality of electrical buss bars, each of said buss bars having a plurality of second apertures therein and spring tabs extending into said second apertures, (3) removing selected ones of said collars, (4) removing selected ones of said spring tabs, and (5) assembling said electrical buss bars on said one wafer such that those of said second apertures having their spring tabs removed fit around the remaining collars.

* * * * *